US007269903B2

(12) United States Patent
Yeh

(10) Patent No.: US 7,269,903 B2
(45) Date of Patent: Sep. 18, 2007

(54) COMBINATION HAIRDRESSING SCISSOR ASSEMBLY

(76) Inventor: Wen-Ya Yeh, 15F-2, No. 18, Chorng Shyue Road, Tainan City (TW) 70156

( * ) Notice: Subject to any disclaimer, the term of this patent is extended or adjusted under 35 U.S.C. 154(b) by 106 days.

(21) Appl. No.: 11/187,642

(22) Filed: Jul. 21, 2005

(65) Prior Publication Data

US 2007/0017102 A1 Jan. 25, 2007

(51) Int. Cl.
*B26B 13/00* (2006.01)

(52) U.S. Cl. ..... 30/226; 30/227; 30/254

(58) Field of Classification Search ..... 30/145–147, 30/194–197, 226, 227, 229, 254, 260, 123, 30/148, 149, 150; 132/213; D8/5, 57; 403/322.2
See application file for complete search history.

(56) References Cited

U.S. PATENT DOCUMENTS

| | | | | | |
|---|---|---|---|---|---|
| 596,213 | A * | 12/1897 | Loewenthal | ..... | 30/226 |
| 1,288,617 | A * | 12/1918 | Kupiszewski | ..... | 30/324 |
| 1,715,898 | A * | 6/1929 | Carri | ..... | 30/227 |
| 5,875,553 | A * | 3/1999 | Geib et al. | ..... | 30/226 |
| 5,996,592 | A * | 12/1999 | Choy | ..... | 132/200 |
| 6,192,590 | B1 | 2/2001 | Yeh | | |
| 6,434,833 | B1 * | 8/2002 | Yeh | ..... | 30/226 |
| 6,557,263 | B1 * | 5/2003 | Yeh | ..... | 30/226 |
| 6,601,304 | B2 * | 8/2003 | Yeh | ..... | 30/226 |
| 6,634,106 | B2 | 10/2003 | Yeh | | |
| 6,748,662 | B2 * | 6/2004 | Yeh | ..... | 30/226 |
| 6,990,739 | B2 * | 1/2006 | Yeh | ..... | 30/226 |
| 2006/0005396 | A1 * | 1/2006 | Yeh | ..... | 30/131 |
| 2006/0150424 | A1 * | 7/2006 | Yeh | ..... | 30/226 |
| 2006/0150425 | A1 * | 7/2006 | Yeh | ..... | 30/226 |

* cited by examiner

*Primary Examiner*—Stephen Choi

(57) ABSTRACT

A combination hairdressing scissor assembly includes pairs of hairdressing scissors, each formed of two cutting members pivotally connected together, a coupling structure set between each two pairs of hairdressing scissors for enabling the hairdressing scissors to be slidably coupled together, and a positioning structure formed in each pair of hairdressing scissors for enabling the pairs of hairdressing scissors to be locked by engaging the spring-supported steel ball of the positioning structure of one pair of hairdressing scissors into the receiving portion of the positioning structure of another pair of hairdressing scissors.

12 Claims, 10 Drawing Sheets

COMBINATION HAIRDRESSING SCISSOR ASSEMBLY

BACKGROUND OF THE INVENTION

1. Field of the Invention

The present invention relates to hairdressing scissors and more particularly, to a combination hairdressing scissor assembly, which has a scissor positioning structure in each pair of hairdressing scissors.

2. Description of the Related Art

Various combination hairdressing scissors assemblies are known. Exemplars of combination hairdressing scissors are seen in U.S. Pat. Nos. 6,192,590B1 and 6,634,106B2. These known designs, which are invented by the present inventor, allow connection of multiple pairs of hairdressing scissors at different elevations in a good order for simple cutting, trimming, and multi-layer cutting operations. However, these known designs still have drawbacks.

As shown in FIG. 1, a connection structure 80 is provided between two pairs of hairdressing scissors 1 for allowing connection of the two pairs of hairdressing scissors 1. The connection structure 80 comprises two coupling grooves 81 respectively formed in the first and second cutting members 10 and 20 of one of the two pairs of hairdressing scissors 1 at one side, and two coupling hooks 82 respectively formed in the first and second cutting members 10 and 20 of the other of the two pairs of hairdressing scissors 1 at one side. By coupling the coupling hooks 82 to the coupling grooves 81 respectively, the two pairs of hairdressing scissors 1 are coupled together. However, because the connection between the coupling grooves 81 and the coupling hooks 82 is a "slip joint", the two pairs of hairdressing scissors 1 tend to slip relative to each other. When operating a combination hairdressing scissor assembly of this design with one single handle, the multiple pairs of hairdressing scissors tend to slip relative to one another, hindering the manipulation of the hand.

SUMMARY OF THE INVENTION

The present invention has been accomplished under the circumstances in view.

According to the present invention, the combination hairdressing scissor assembly comprises a plural pairs of hairdressing scissors, the pair of hairdressing scissors each comprising two cutting members pivotally connected together, a connection structure provided between each two adjacent pairs of hairdressing scissors for enabling the respective two pairs of hairdressing scissors to be slidably coupled together, and a positioning structure formed in each pair of hairdressing scissors for enabling the pairs of hairdressing scissors to be locked to one another. The positioning structure comprises a through hole transversely cut through one cutting member, the through hole having a front end and a rear end, an annular flange extending around the front end of the through hole, a stop member affixed to the inside of the through hole and spaced between the front end and the rear end, a retaining member movably mounted in the through hole between the annular flange and the stop member and partially extendable out of the annular flange, a spring member mounted in the through hole and connected between the stop member and the retaining member and supporting the retaining member against the annular flange, and a receiving portion defined in the rear end of the through hole for receiving a part of the retaining member of the positioning structure at another one of the pairs of hairdressing scissors.

DETAILED DESCRIPTION OF THE PREFERRED EMBODIMENT

Figure 1:
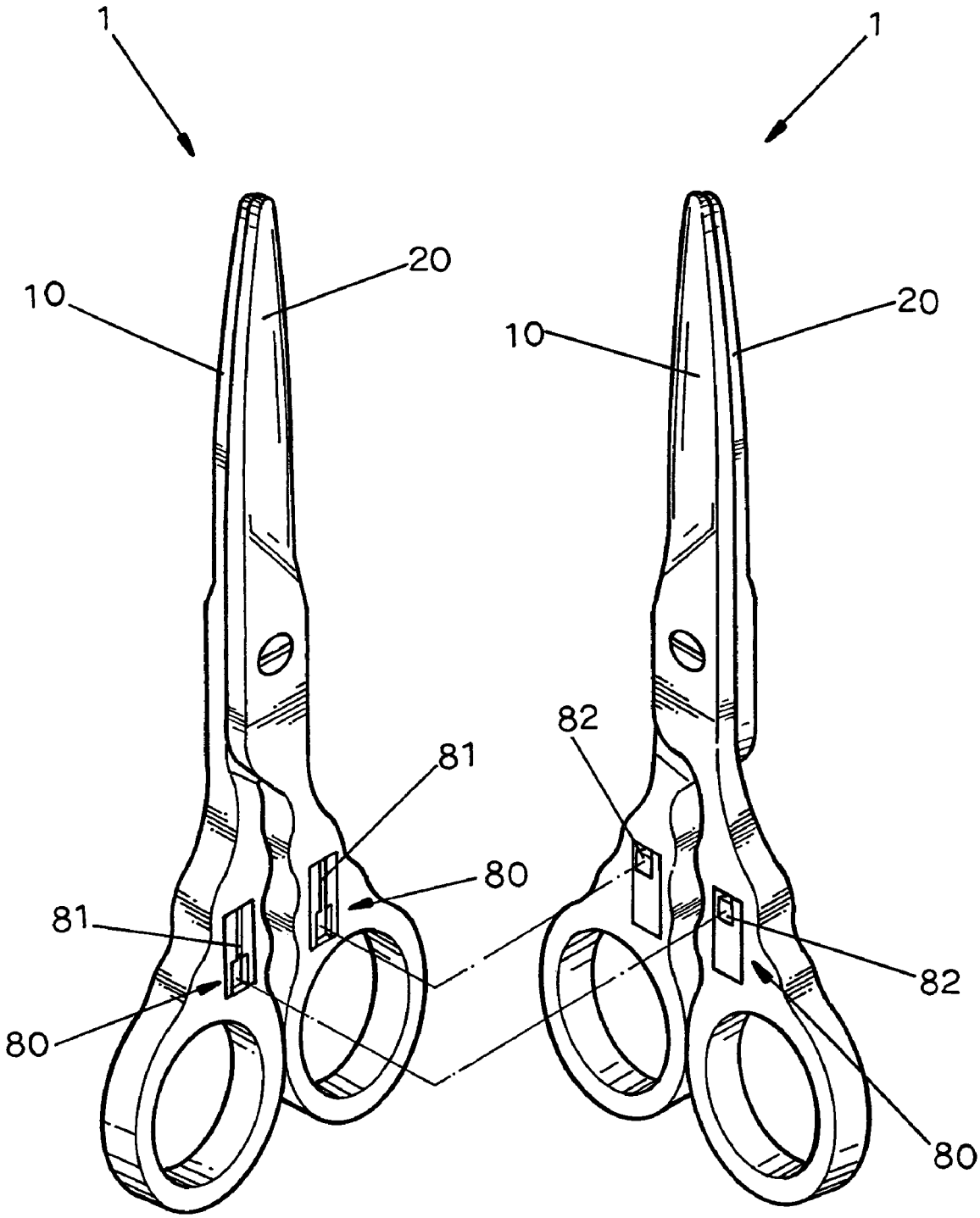
Fig.1 (Prior Art)
FIG. 1 is an exploded view of a combination hairdressing scissor assembly according to the prior art
Figure 2:
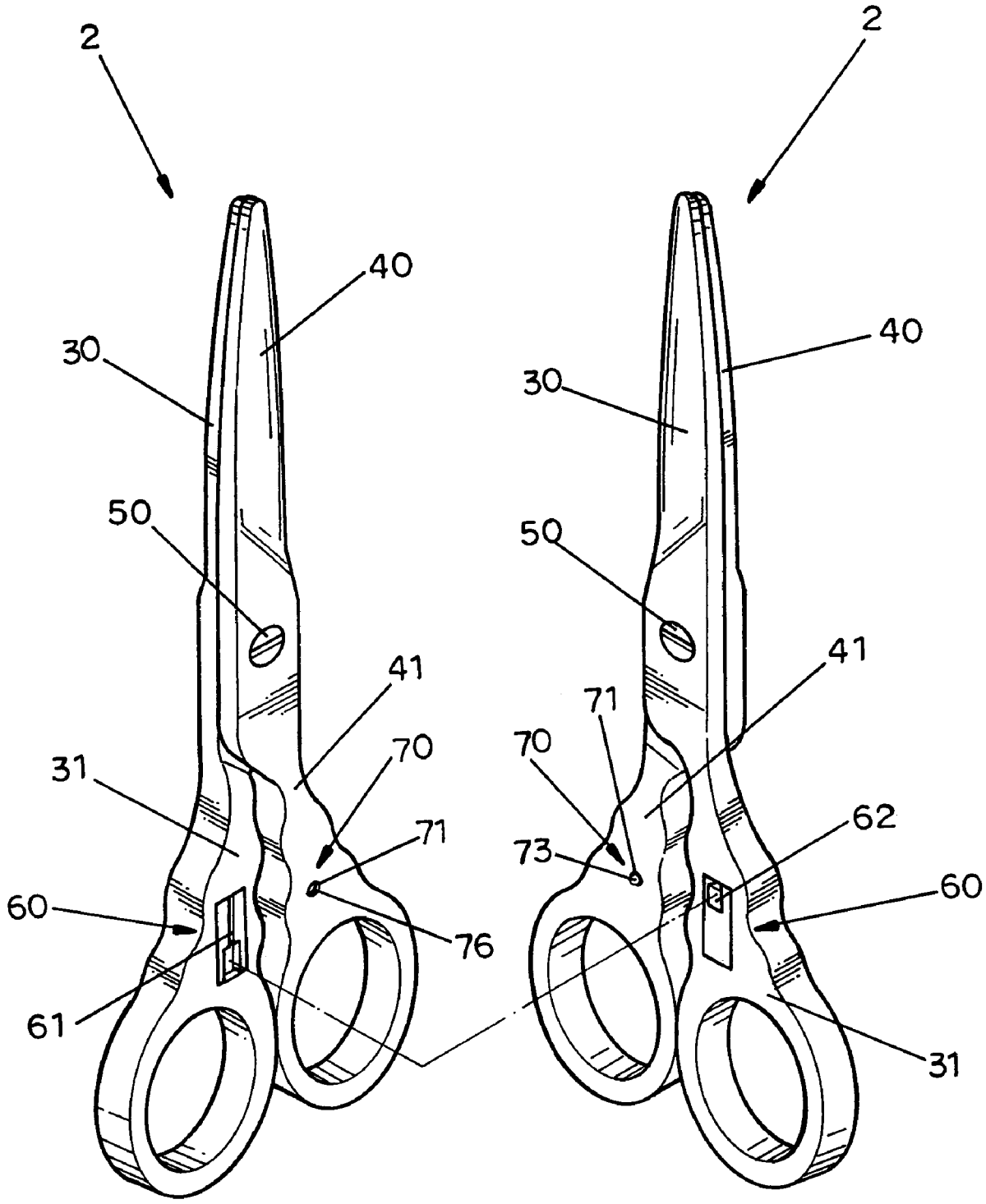
FIG. 2 is an exploded view of a part of a combination hairdressing scissor assembly according to the present invention.
Figure 3:
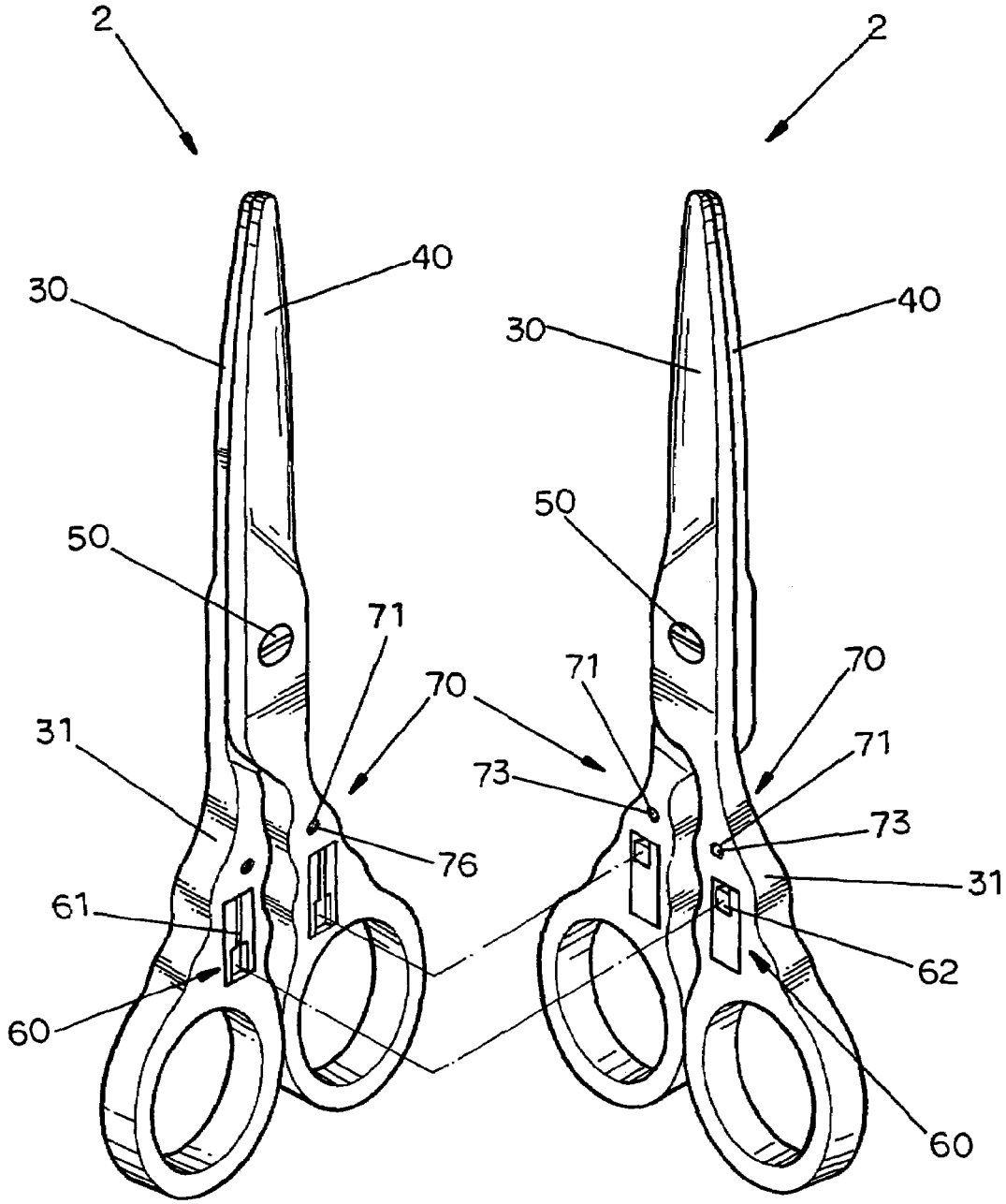
FIG. 3 is an exploded view of a part of an alternate form of the combination hairdressing scissor assembly according to the present invention.
Figure 4:
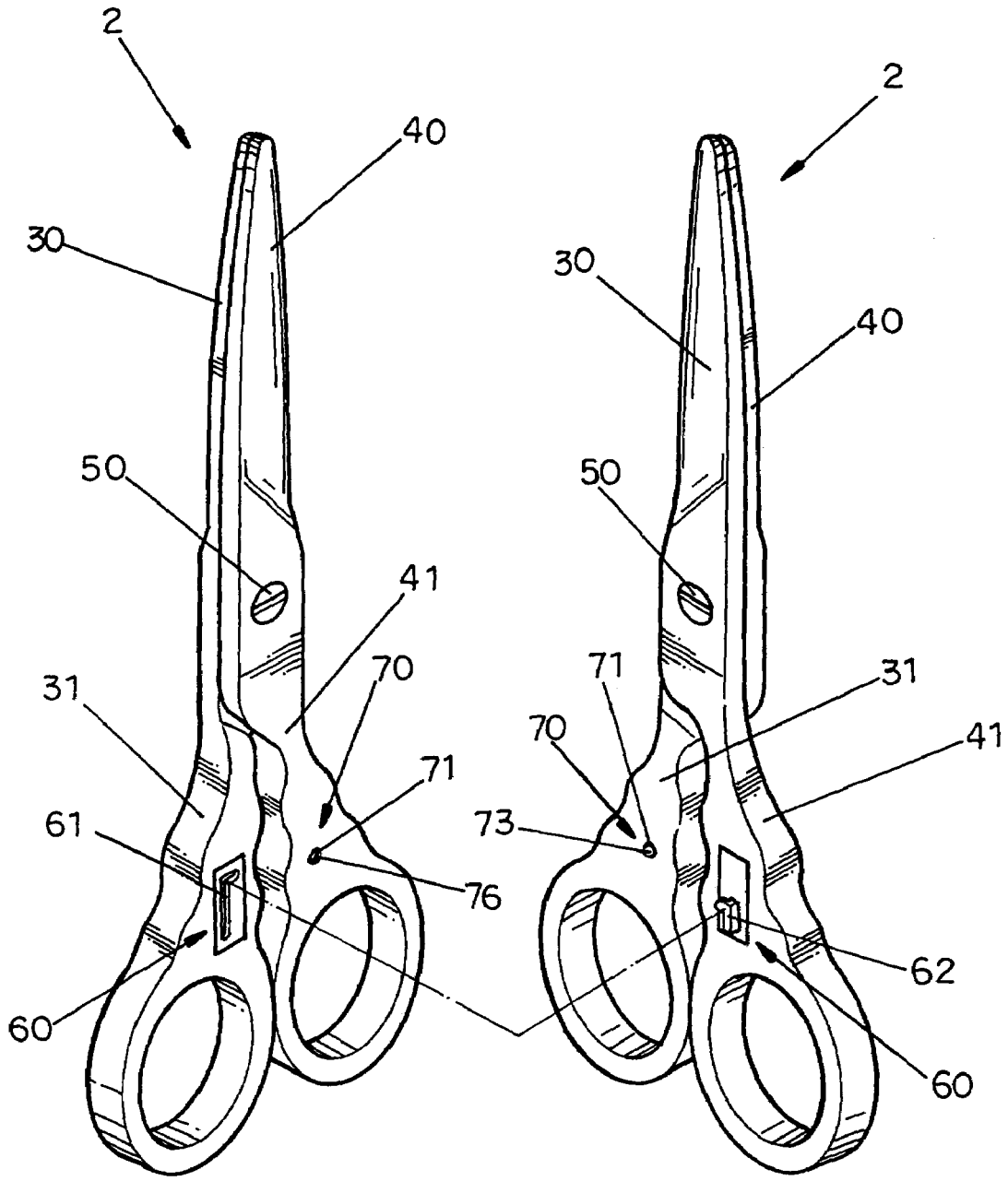
FIG. 4 is an exploded view of a part of the combination hairdressing scissor assembly according to the present invention.
Figure 5:
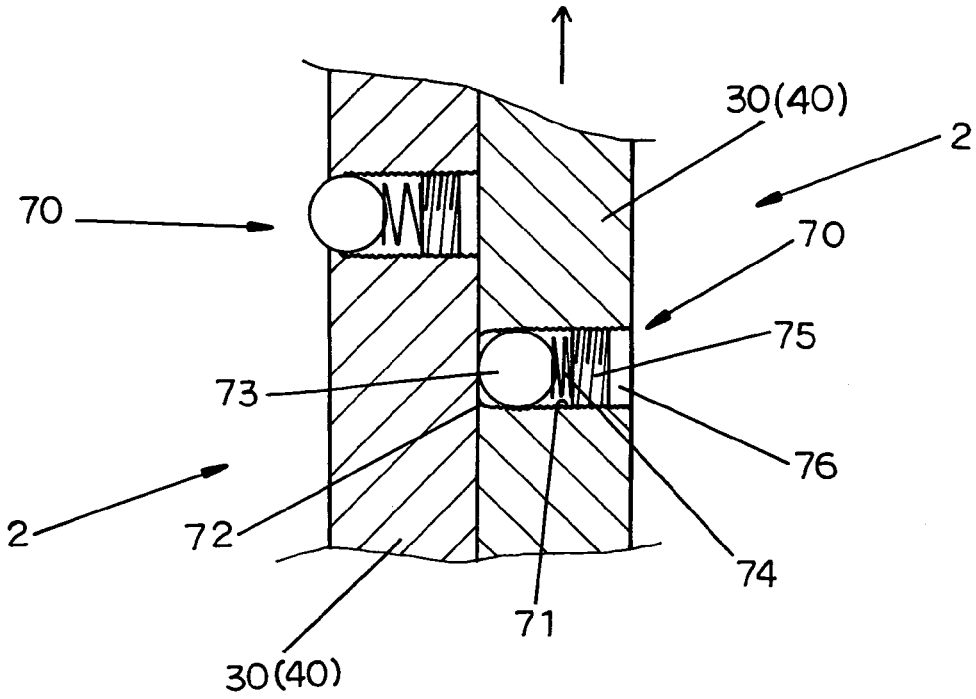
FIG. 5 is a schematic sectional view, showing the unlocked status of two attached pairs of hairdressing scissors according to the present invention where the steel ball of the positioning structure of one pair of hairdressing scissors stopped against the outside wall of one cutting member of the other pair of hairdressing scissors.

Referring to FIGS. 2~5 and 7, a combination hairdressing scissor assembly is shown comprising pairs of hairdressing scissors 2 each having first and second cutting members 30 and 40 that are pivoted together by a pivot 50. The first cutting member 30 comprises a first handle 31 on one end thereof. The second cutting member 40 comprises a second handle 41 on one end thereof. The combination hairdressing scissor assembly further comprises a connection structure 60 between each two adjacent pairs of hairdressing scissors 2, and a positioning structure 70 at each pair of hairdressing scissors 2 The connection structure 60 comprises at least one female coupling portion (dovetailed coupling groove or L-shaped coupling groove) 61 formed in the handle or handles 31 and/or 41 of one of the two pairs of hairdressing scissors 2, and at least one male coupling portion (dovetailed coupling flange or L-shaped coupling flange) 62 formed in the handle or handles 31 and/or 41 of the other of the two pairs of hairdressing scissors 2 for coupling to the at least one female coupling portion (dovetailed coupling groove or L-shaped coupling groove) 61 to couple the two pairs of hairdressing scissors 2 together. The positioning structure 70 comprises a through hole 71 transversely cut through the handle of one cutting member, for example, the handle 41 of the second cutting member 40, an annular flange 72 extending around one end, namely, the front end of the through hole 71, a movable retaining member, for example, a steel ball 73 movably mounted in the through hole 71 and partially extendable out of the annular flange 72, a stop member 75 fixedly mounted in the through hole 71 near the other end, namely, the rear end of the through hole 71, a spring member (coil spring or spring leaf) 74 connected between the stop member 75 and the steel ball 73 in the through hole 71 to force the steel ball 73 against the annular flange 72, and a receiving portion 76 defined in the rear end of the through hole 71 behind the stop member 75.

Figure 7:
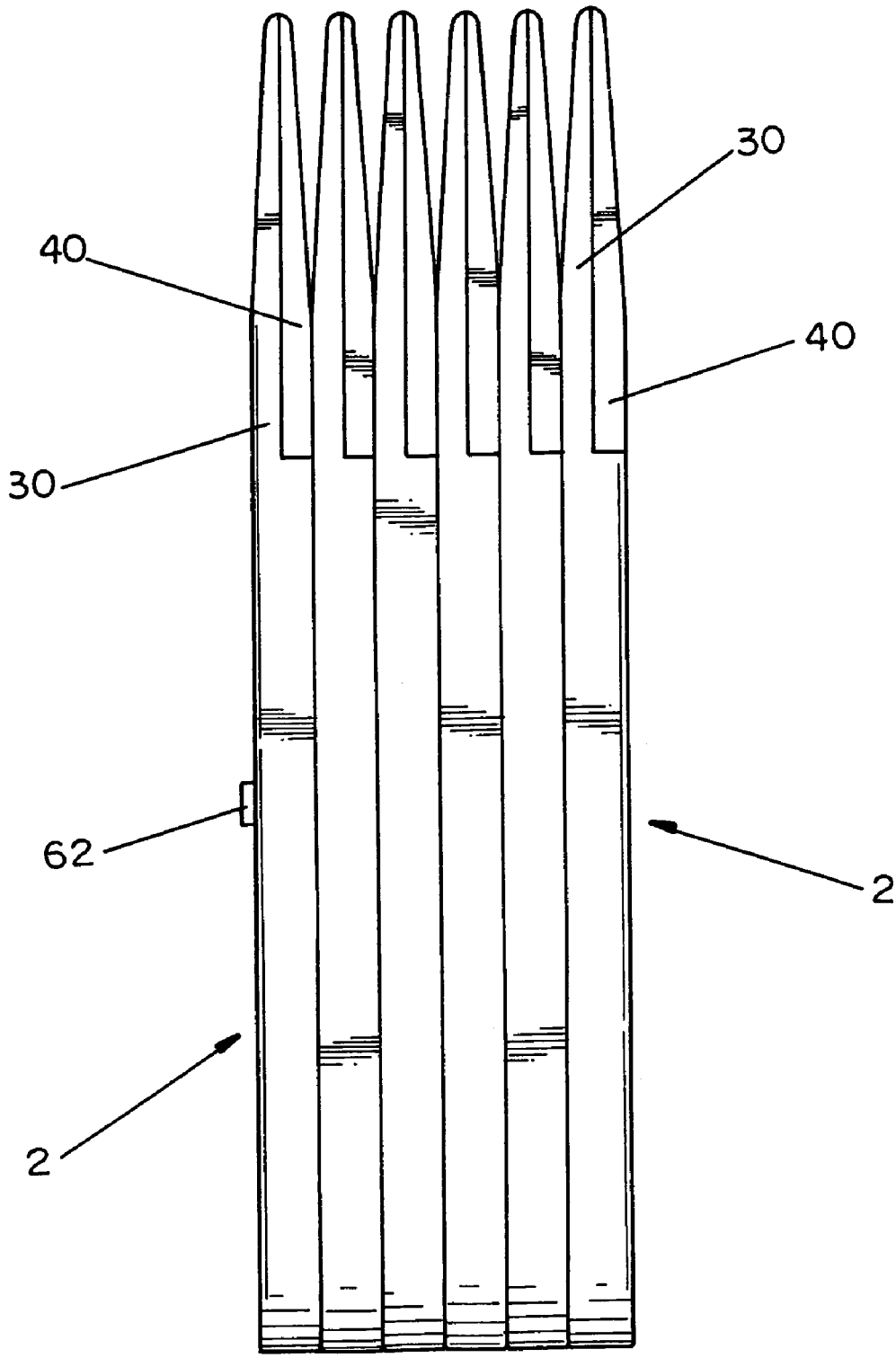
FIG. 7 is a plain view of the present invention, showing the pairs of hairdressing scissors of the combination hairdressing scissor assembly set at the same elevation.
Figure 8:
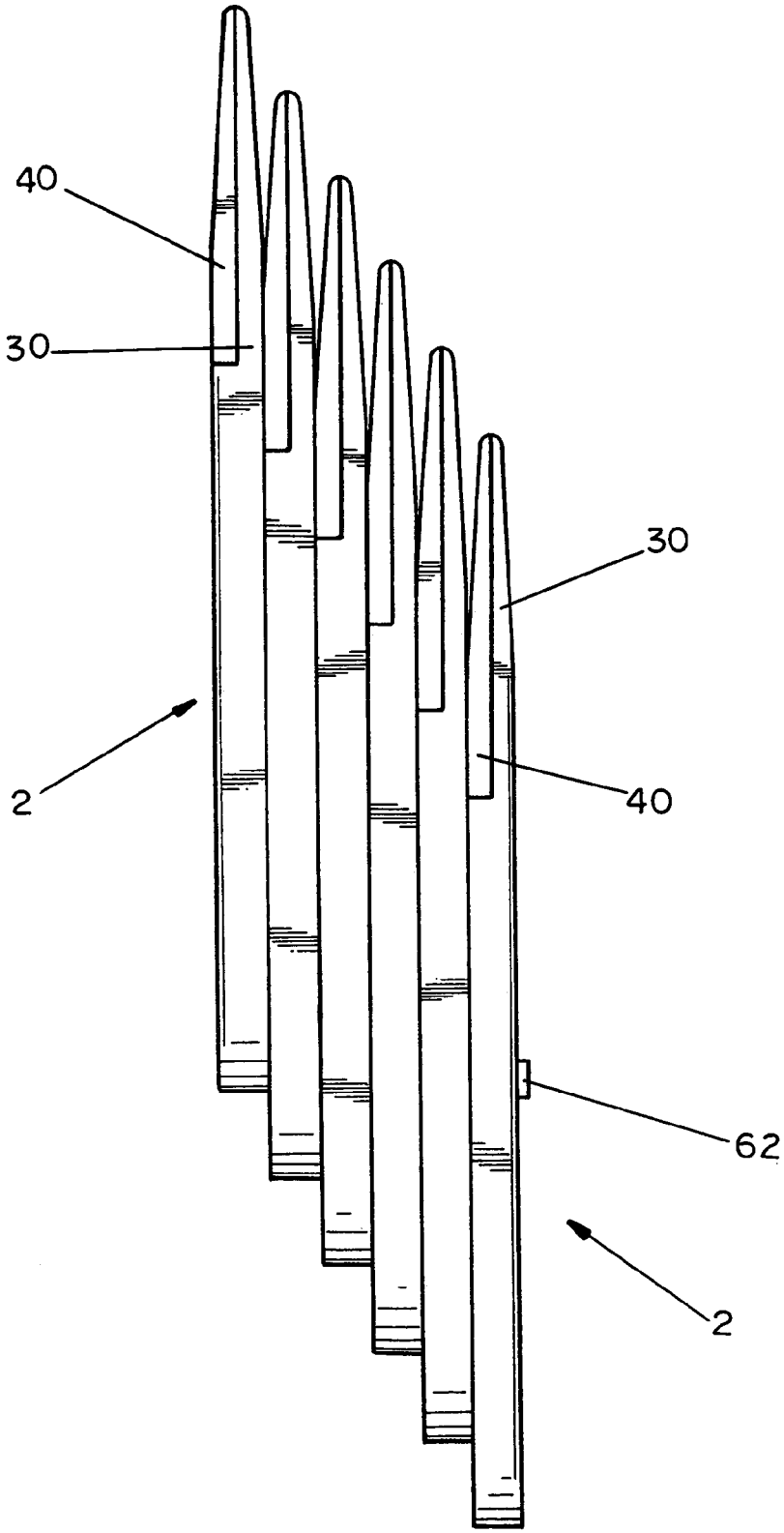
FIG. 8 is a plain view of the present invention, showing the pairs of hairdressing scissors of the combination hairdressing scissor assembly set at different elevation and protruded one over another in leftward direction.
Figure 9:
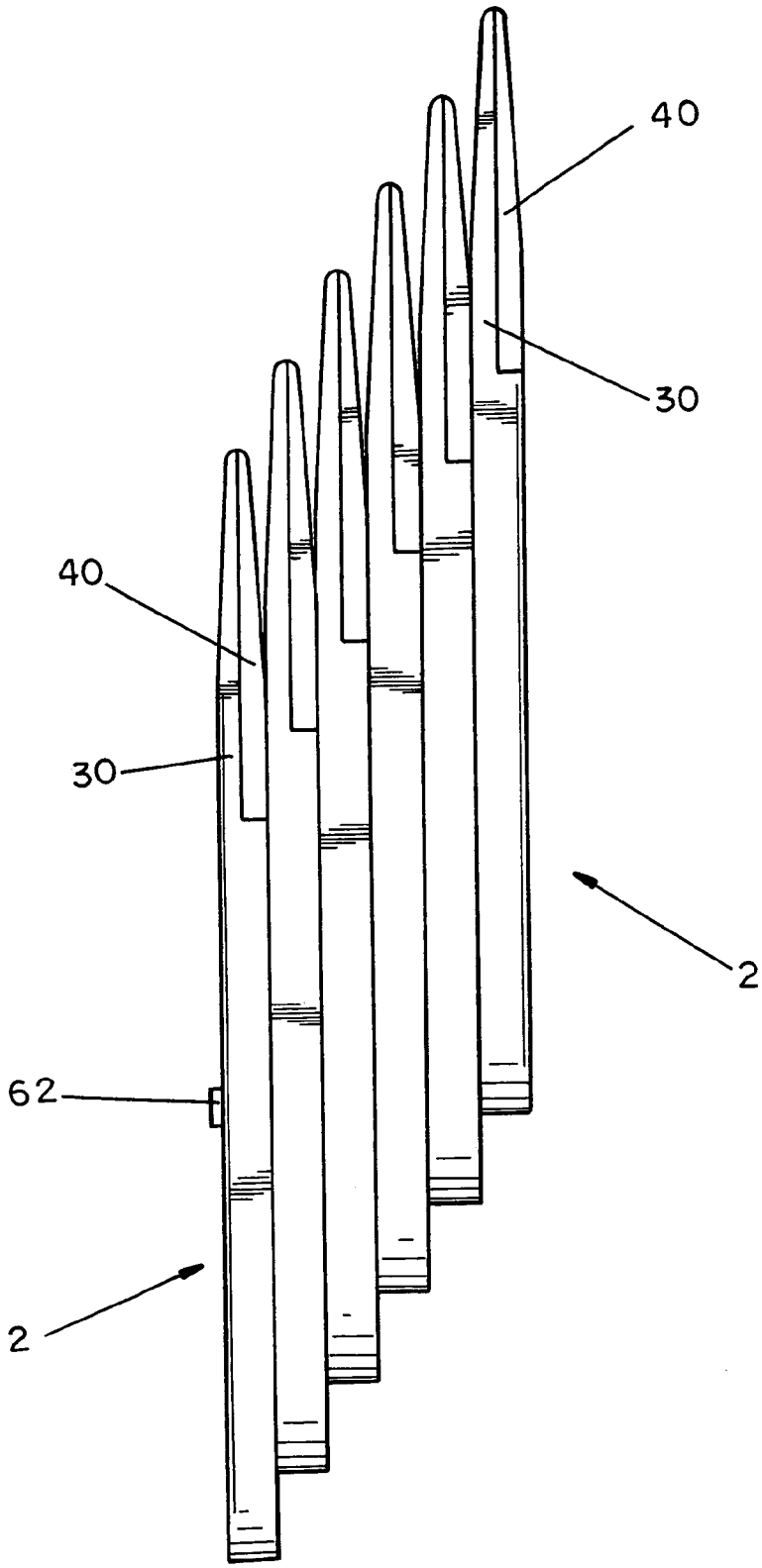
FIG. 9 is a plain view of the present invention, showing the pairs of hairdressing scissors of the combination hairdressing scissor assembly set at different elevation and protruded one over another in rightward direction.

Referring to FIGS. 8 and 9 and FIGS. 2~4 and 7 again, by means of coupling the male coupling portion 62 of each connection structure 60 to the female coupling portion 61 of the respective connection structure 60, pairs of hairdressing scissors 2 are coupled together and set in parallel at the same elevation (see FIG. 7). Alternatively, the operator can set the coupled pairs of hairdressing scissors 2 at different elevations in a good order (see FIGS. 8 and 9) for different cutting or trimming operations.

Figure 6:
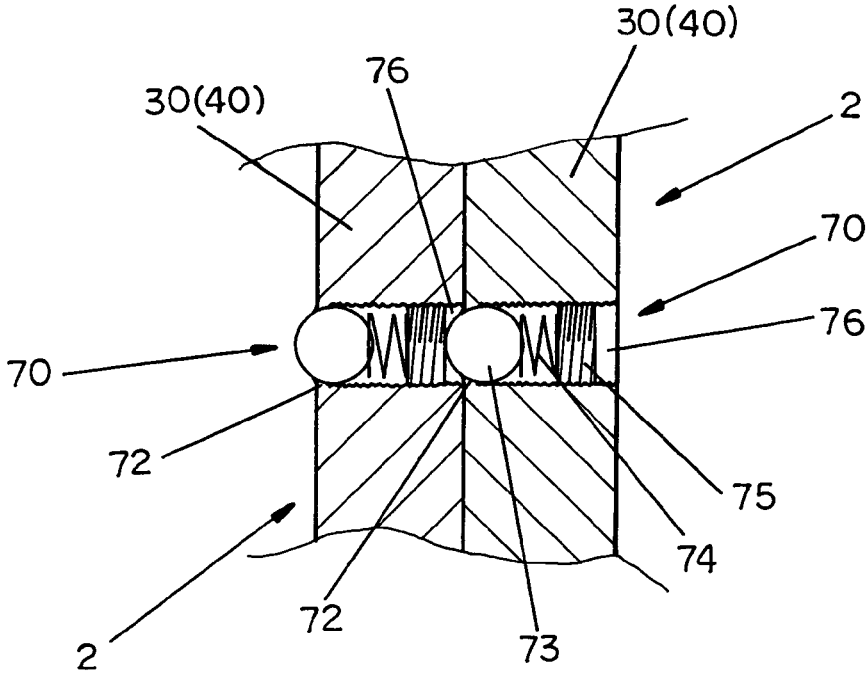
FIG. 6 corresponds to FIG. 5, showing the steel ball of the positioning structure of one pair of hairdressing scissors engaged into the receiving portion of the positioning structure of the other pair of hairdressing scissors.

Referring to FIG. 6 and FIG. 5 again, when two pairs of hairdressing scissors 2 are coupled together and set at different elevations, the steel ball 73 of the positioning structure 70 at a first one of the two pairs of hairdressing scissors 2 is stopped against the outside wall of the second one of the two pairs of hairdressing scissors 2 (see FIG. 5). When the user moved the two pairs of hairdressing scissors 2 to a brush manner, the steel ball 73 of the positioning structure 70 at the first one of the two pairs of hairdressing scissors 2 is forced outwards by the respective spring member 74 to engage into the receiving portion 76 of the positioning structure 70 at the second one of the two pairs of hairdressing scissors 2 (see FIG. 6).

Figure 10:
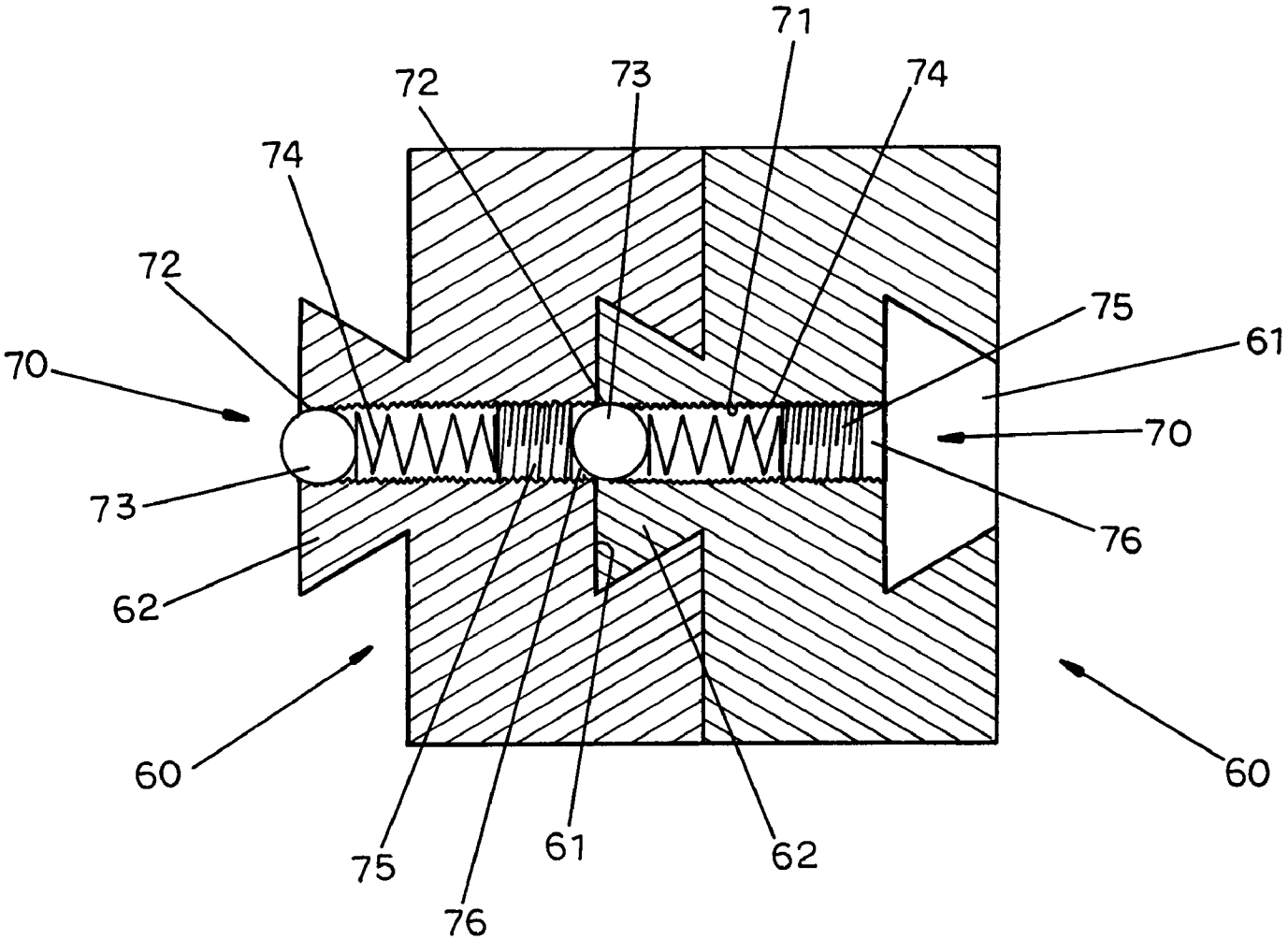
FIG. 10 is a sectional view showing the positioning structure formed in the connection structure according to the present invention.

Referring to FIG. 10, the positioning structure 70 can be directly formed in the connection structure 60, achieving the same positioning effect.

Figure 11:
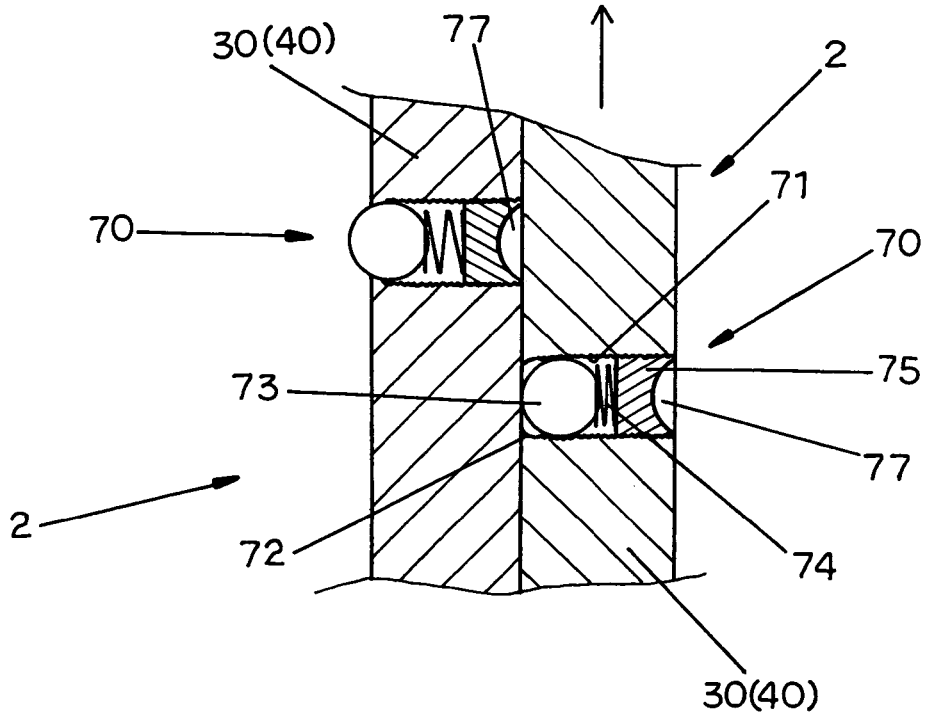
FIG. 11 is similar to FIG. 5 but showing a recessed portion formed in the back wall of the stop member.
Figure 12:
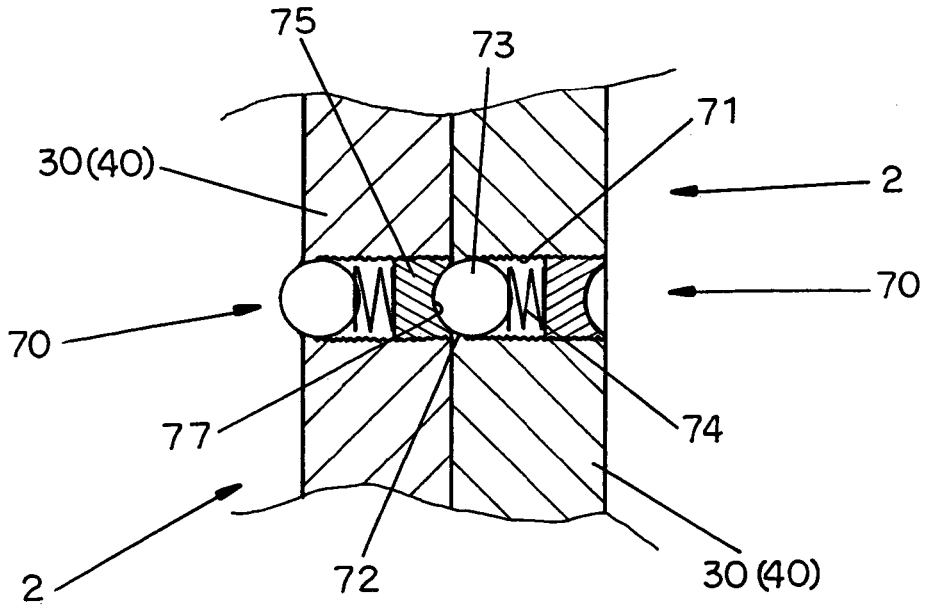
FIG. 12 corresponds to FIG. 11, showing the steel ball of the positioning structure of one pair of hairdressing scissors engaged into the recessed portion of the stop member of the positioning structure of the other pair of hairdressing scissors.

Referring to FIGS. 11 and 12, the stop member 75 can be made having a recessed portion 77 smoothly curved inwards in the back wall thereof for receiving the steel ball 73 of the positioning structure 70 at another pair of hairdressing scissors 2.

Further, the stop member 75 can be fastened to the inside of the through hole 71 by a screw joint, friction connection, adhesive, welding, or any of a variety of known techniques. In the aforesaid embodiments, the through hole 71 has an inner thread, and the stop member 75 is a screw member threaded into the inner thread of the through hole 71.

As indicated above, the invention enables multiple pairs of hairdressing scissors 2 to be coupled together and alternatively set at the same elevation or at different elevations. When set the connected pairs of hairdressing scissors 2 at the same elevation, the steel ball 73 of the positioning structure 70 of one pair of hairdressing scissors 2 is engaged into the receiving portion 76 of the positioning structure 70 of another pair of hairdressing scissors 2, holding the pairs of hairdressing scissors 2 firmly at the same elevation.

Although particular embodiments of the invention have been described in detail for purposes of illustration, various modifications and enhancements may be made without departing from the spirit and scope of the invention.

What the invention claimed is:

1. A combination hairdressing scissor assembly comprising a plural pairs of hairdressing scissors, said pair of hairdressing scissors each comprising two cutting members pivotally connected together, and a connection structure provided between each two adjacent pairs of hairdressing scissors for enabling the respective two pairs of hairdressing scissors to be slidably coupled together, wherein said pairs of hairdressing scissors each comprise a positioning structure formed in at least one of the two cutting members for enabling said pairs of hairdressing scissors to be locked, said positioning structure comprises a through hole transversely cut through one cutting member, said through hole having a front end and a rear end, an annular flange extending around the front end of said through hole, a stop member affixed to the inside of said through hole and spaced between said front end and said rear end, a retaining member movably mounted in said through hole between said annular flange and said stop member and partially extendable out of said annular flange, a spring member mounted in said through hole and connected between said stop member and said retaining member and supporting said retaining member against said annular flange, and a receiving portion defined in the rear end of said through hole for receiving a part of the retaining member of the positioning structure at another one of said pairs of hairdressing scissors.

2. The combination hairdressing scissor assembly as claimed in claim 1, wherein said stop member is fastened to said through hole through a screw joint.

3. The combination hairdressing scissor assembly as claimed in claim 1, wherein said stop member has a recessed portion smoothly curved inwards in a back wall thereof.

4. The combination hairdressing scissor assembly as claimed in claim 1, wherein said positioning structure is formed in the connection structure at the respective pair of hairdressing scissors.

5. The combination hairdressing scissor assembly as claimed in claim 1, wherein said spring member is a coil spring.

6. The combination hairdressing scissors assembly as claimed in claim 1, wherein said retaining member is a round ball.

7. A pair of hairdressing scissors comprising:

two cutting members pivotally connected together;

a connection structure formed in at least one of the two cutting members for enabling two adjacent pairs of hairdressing scissors to be slidably coupled together; and a positioning structure formed in at least one of the two cutting members for enabling the two adjacent pairs of hairdressing scissors to be locked, said positioning structure comprises a through hole transversely cut through said at least one cutting member, said through hole having a front end and a rear end, a flange extending around the front end of said through hole, a stop member affixed to the inside of said through hole, a retaining member movably mounted in said through hole between said flange and said stop member and partially extendable out of said front end, a spring member mounted in said through hole and between said stop member and said retaining member and supporting said retaining member against said flange, wherein the rear end of said through hole may receive a part of the retaining member of the positioning structure at another pair of hairdressing scissors.

8. The pair of hairdressing scissors as claimed in claim 7, wherein said stop member is fastened to said through hole through a screw joint.

9. The pair of hairdressing scissors as claimed in claim 7, wherein said stop member has an inward recessed portion in a back wall thereof.

10. The pair of hairdressing scissors as claimed in claim 7, wherein said positioning structure is formed in the connection structure.

11. The pair of hairdressing scissors as claimed in claim 7, wherein said spring member is a coil spring.

12. The pair of hairdressing scissors as claimed in claim 7, wherein said retaining member is a round ball.

* * * * *